United States Patent [19]

Chambers, Sr.

[11] Patent Number: 5,060,872

[45] **Date of Patent: * Oct. 29, 1991**

[54] ROTARY SCREEN DIVERTER AND SOLID WASTE HANDLING SYSTEM USING SAME

[75] Inventor: Joseph W. Chambers, Sr., Rancho LaCosta, Calif.

[73] Assignee: Chambers, Boyd, McKinley and Associates, Santa Ana, Calif.

[ * ] Notice: The portion of the term of this patent subsequent to Apr. 24, 2007 has been disclaimed.

[21] Appl. No.: 461,509

[22] Filed: Jan. 5, 1990

Related U.S. Application Data

[62] Division of Ser. No. 125,951, Nov. 27, 1987, Pat. No. 4,919,346.

[51] Int. Cl.[5] ..... B02C 18/22; B02C 18/40; B02C 23/36

[52] U.S. Cl. ..... 241/46.02; 210/160; 210/173; 241/46.06; 241/81

[58] Field of Search ..... 241/81, 46 R, 46.02, 241/46.06, 186 R, 46 B; 209/361, 350, 307, 240, 270; 210/160, 173

[56] References Cited

U.S. PATENT DOCUMENTS 2,106,851 2/1938 Nordell ..... 241/46.02 X 3,508,659 4/1970 Bates et al. ..... 210/160

*Primary Examiner*—Joseph M. Gorski

*Attorney, Agent, or Firm*—Sughrue, Mion, Zinn, Macpeak & Seas

[57] ABSTRACT

A solid waste handling system for screening and grinding solids entrained in an influent liquid stream flowing within a chute between laterally spaced vertical sidewalls utilizes at least one solids diverter horizontal rotating screen unit fixedly mounted within the chute and at an angle to the influent liquid stream with an endless loop open mesh screen mounted for rotation on a frame assembly such that one upstream face of the screen is vertical and moves horizontally across the stream in a direction towards the downstream offset grinder unit. The grinder unit has a housing with an upstream facing inlet port and mounts internally within the housing stacked interengaging shredding members for rotation about their axes in the path of flow of the solids bearing influent. Motors mounted to the units above the influent liquid stream level drive the screen and shredding members of respective units. Multiple screen units and multiple grinder units may be employed with the multiple screen units in stacked array, in end overlapping position, and with the endless screens driven to deflect solids towards one or more grinder units offset below the most downstream screen unit of the array.

21 Claims, 4 Drawing Sheets

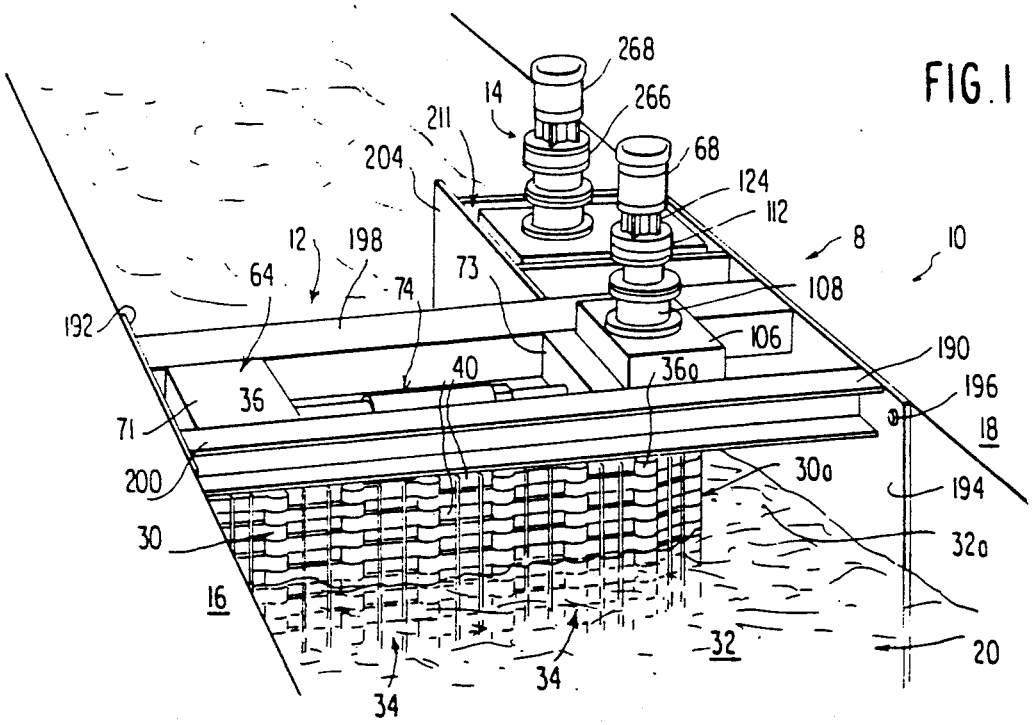
FIG. 1
FIG. 1A
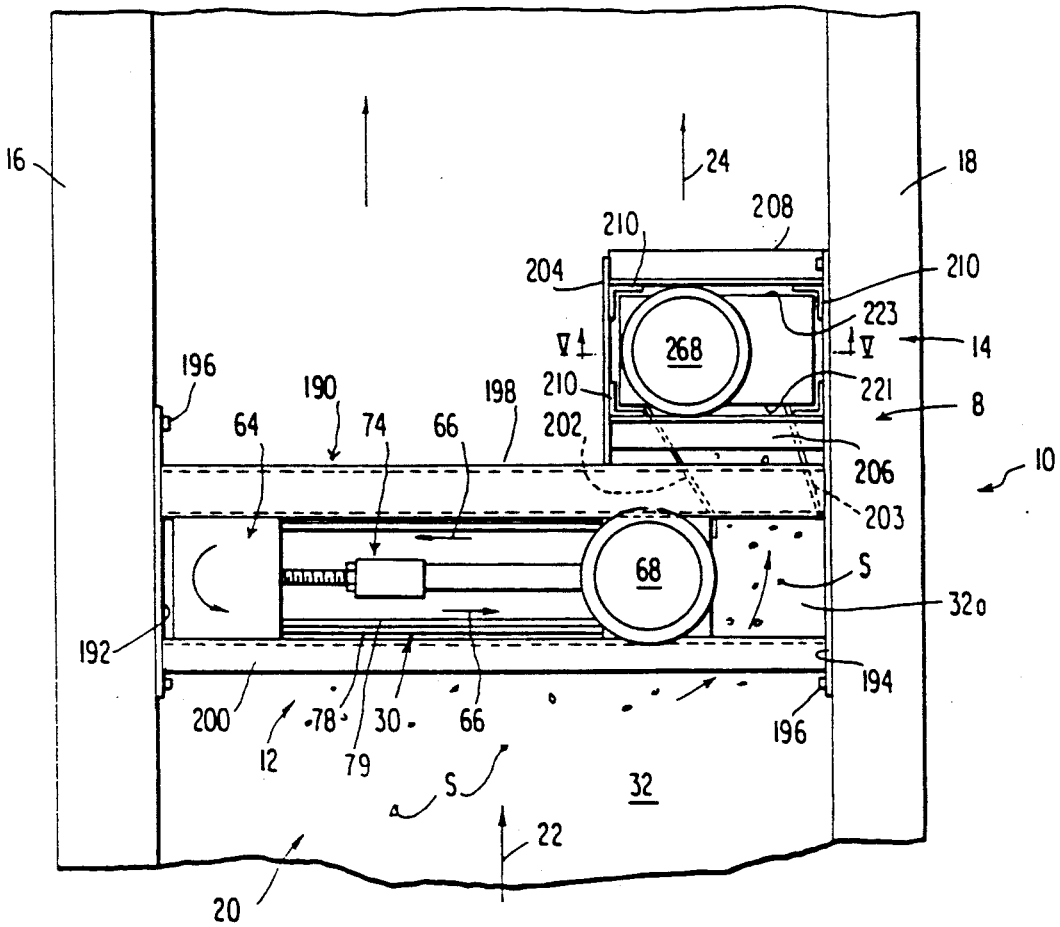

ROTARY SCREEN DIVERTER AND SOLID WASTE HANDLING SYSTEM USING SAME

This is a division of application Ser. No. 07/125,951 filed Nov. 27, 1987 and now U.S. Pat. No. 4,919,346.

FIELD OF THE INVENTION

This invention relates to solid waste handling systems of the type employing a solid waste grinder for shredding, crushing and grinding solid waste material carried by a liquid influent, and more particularly to a rotary screen diverter which collects and diverts solid waste within the influent stream into the inlet of the grinder.

BACKGROUND OF THE INVENTION

A highly effective, solid waste grinder has been developed in recent years for shredding, crushing and grinding solid waste material carried by a liquid influent stream in which two interacting stacks of shredding members are mounted on substantially parallel vertical shafts, positioned in transverse arrangement relative to the direction of waste material introduction into a grinder or comminutor apparatus. The shredding members of one stack interact with the shredding members of the other stack, with the rotating shredding members of respective stacks being separated by spacers, wherein the distances between the teeth of a cutting element with an opposing spacer differing as between different ones of pairs of interacting shredding members and wherein teeth provided on at least one member of each pair of shredding members for cutting in both directions of stack rotation. U.S. Pat. No. 4,046,324, assigned to the common corporate assignee, is exemplary of such solid waste shredding crushing and grinding apparatus.

While such shredding, crushing and grinding apparatus works very effectively and permits the fine solids ground during flow passage of the influent stream through the apparatus to be retained within the liquid, where large flows are required, there is a necessity to stack a relatively large number of such apparatuses side by side, so that the influent flow rate is not severely diminished by the presence of the solid waste grinding apparatus. Additionally, since the grinding apparatus is required to see only the major portion of the solid waste carried by the influent, there is a need in the industry to effectively concentrate within the portion of the liquid influent passing through the grinding apparatus, the solid waste carried by the influent.

It is therefore a primary object of the present invention to provide an improved waste handling system using one or more solid waste grinder units positioned in the path of an influent stream carrying the solid waste, in which the solid waste is effectively concentrated and moves with minimum effort into the inlet of the grinding apparatus, wherein the grinder units involve stacked interacting shredding members, wherein a solid waste diversion mechanism is employed, which is of simplified construction, which is readily adjustable to match varying width influent streams and wherein, the solids diversion mechanism is of a type which concentrates the solids and diverts the influent upstream of a grinder unit or units and which facilitates the introduction of the concentrated solids into the inlet of such grinder unit.

SUMMARY OF THE INVENTION

A solid waste handling system for screening and grinding solids entrained in an influent liquid stream flowing within a flow confining chute having a bottom wall and laterally spaced vertical sidewalls defining a flow channel for the stream is formed of at least one solids diverter horizontal rotating screen unit and a downstream offset grinder unit at an end thereof having an inlet port facing upstream to receive solids entrained by an endless loop open mesh screen mounted for rotation on a frame assembly of the screen unit such that one upstream face of the screen is vertical and moves horizontally across the stream in the direction towards the end of the screen unit proximate to the downstream offset grinder unit. The solids diverter horizontal rotating screen unit is fixedly mounted within the chute having one end proximate to the one sidewall and extending towards the other sidewall at an angle to the flow direction of the stream while the grinder unit to the side remote from the screen unit is fixed to the other sidewall of the chute.

An open frame support assembly fixedly mounted between the sidewalls of the chute fixedly mount the upper portions of the screen unit and the grinder unit. Preferably, the grinder unit has a housing with an upstream facing inlet port and a downstream facing outlet port and mounts internally within the housing, stacked interengaging shredding members mounted for rotation about their axes in the path of flow of the solids bearing influent through the housing from the inlet port to the outlet port. Motors mounted to the screen and grinder units rotate, respectively the endless loop screen and the interengaging shredding members thereof.

The solid waste handling system may have a single screen unit at right angles or oblique to the influent stream and a single grinder unit offset downstream thereof and at one end of the screen unit. Alternatively, multiple screen units may form a stacked array, in end overlapping position, with one or more grinder units downstream of the most downstream screen unit of the array. The screen unit may have an open frame assembly in the form of left and right vertically spaced upper and lower end housings supporting respective ends of vertically oriented drive and driven shafts mounted for rotation about their axes. A plurality of sprockets may be fixedly mounted to the shafts at axially spaced positions along the shafts for rotation about their axes with the sprockets including radially projecting teeth. The endless loop open mesh screen may comprise linked screen sections with each screen section being formed of a plurality of horizontal, vertically spaced links having enlarged headed ends, horizontally spaced riser strips integral with the links to define with the links rectangular screen mesh openings. The headed ends of horizontal links of adjacent screen sections are interposed with each other with holes thereof aligned and rods projecting through the aligned holes to pivotably couple the links together at the headed ends such that the pivotably coupled screen sections wrap about the sprockets mounted to the drive and driven shafts. A stacked assembly of a speed reducer and a drive motor in that order may be mounted to the upper end housings of the screen unit mounting the drive shaft with a pair of shaft couplers interposed, respectively between the drive motor and the speed reducer for completing a speed reduction drive coupling between an output shaft of the motor and the screen unit drive shaft. The screen unit open frame assembly further includes an upper tensioner operatively coupled between the upper end housings for the drive shaft and driven shaft, respectively and a lower tensioner operatively coupling the lower end housings for rotatably mounting the drive shaft and driven shafts to effect selective adjustment of the tension of the endless loop screen rotatably mounted on sprockets fixed to respective shafts. A secondary tensioner may be interposed between the upper and lower tensioners and the driven shaft assembly including said upper and lower end housings for that shaft. The secondary tensioner includes secondary tensioner adjusting means in juxtaposition to the upper end housing rotatably mounting the driven shaft for permitting adjustment of the screen tension after the screen unit is mounted within the chute.

BRIEF DESCRIPTION OF THE DRAWINGS

FIG. 1 is a perspective view of the improved solid waste handling system utilizing a solids diverter horizontal rotating screen unit for diverting solids within an influent stream into an open inlet of a grinding unit utilizing interengaging stacks of shredding members positioned to the side and downstream of the rotating screen diverter unit and forming one embodiment of the present invention.

FIG. 1A is a top plan view of the system of FIG. 1.

DESCRIPTION OF PREFERRED EMBODIMENTS

Figure 3:
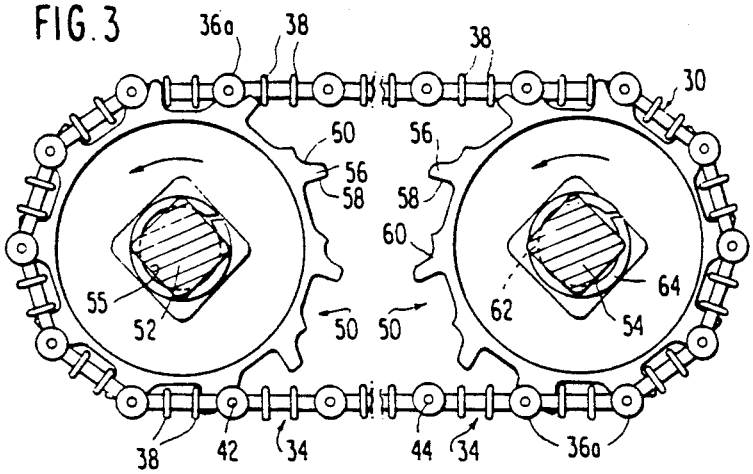
FIG. 3 is a transverse sectional view of the horizontal rotating, solids diverter screen unit taken about line III—III of FIG. 2.

Referring to FIGS. 1–5 inclusive, a solid waste handling system forming a one embodiment of the invention is illustrated generally at 10 and consists of a integrated assembly 8 of a solids diverter horizontal rotating screen unit indicated generally at 12 and a grinder unit indicated generally at 14, mounted within and spanning laterally between opposed vertical sidewalls 16, 18 of a chute or spillway indicated generally at 20. Chute 20 defines a flow channel 32 for a solids influent stream indicated generally by arrow 22, upstream of the assembly 8, with a waste stream or effluent exiting from grinder unit 14, as indicated generally by arrow 24, on the downstream side of the channel defined by the chute or spillway 20.

Grinder unit 14 may be of the type of apparatus illustrated in U.S. Pat. No. 4,046,324 and sold by the corporate assignee of this application under the registered Trademark MUFFIN MONSTER. The makeup of the grinder unit 14 may be seen by reference to U.S. Pat. No. 4,046,324, and by reference to FIG. 5 which is a partial vertical sectional view of unit 14 of FIG. 1.

Figure 4:
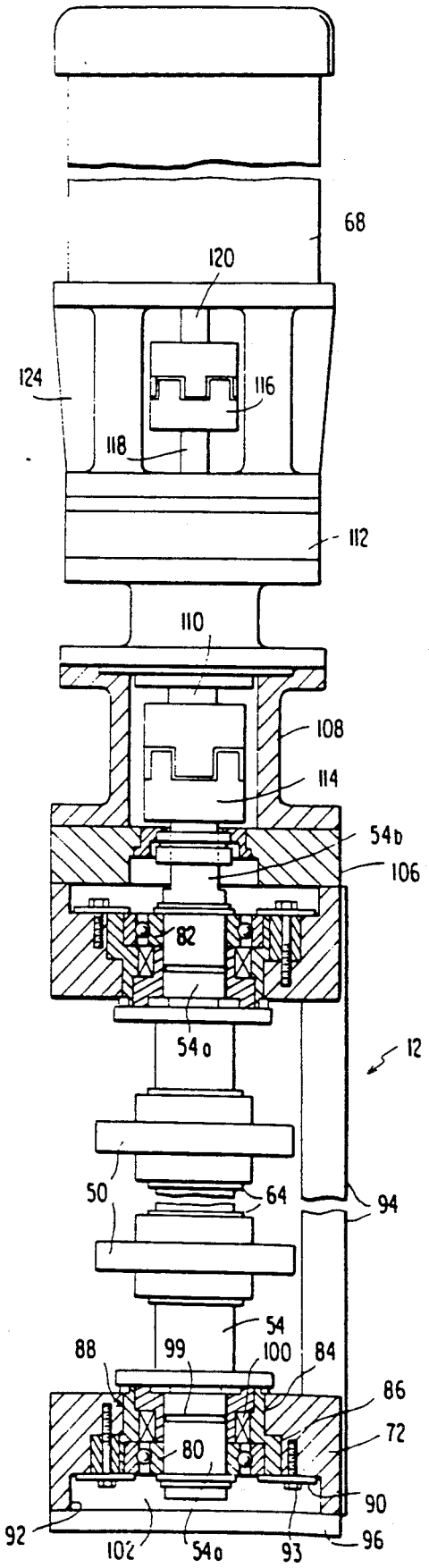
FIG. 4 is a side elevational view, partially broken away of the solids diverter horizontal rotating screen unit of FIGS. 2 and 3.

The solids diverter horizontal rotating screen unit 12 in the embodiment of FIGS. 1–5, includes an endless loop open mesh screen indicated generally at 30 having an upstream length which moves, in this embodiment, at right angles to the direction of the solids influent stream 22. The screen unit 12 is positioned such that one end is in proximity to the vertical sidewall 16 of the chute or spillway 20, while the opposite end stops short of the chute or spillway sidewall 18, so as to form a narrow flow channel section **32*a* between the end of screen 30 and the adjacent sidewall 18. Screen 30 may be made up of a number of linked screen sections 34 consisting of vertically spaced, horizontal links 36 having headed ends 36*a*, integrally joined by a pair of vertical riser strips 38, so as to form a mesh having rectangular openings 40 defined by the links 36 and the riser strips 38 as well as by the headed ends 36*a* of stacked links. The headed ends of one screen section 34 are interposed between headed ends 36*a* of adjacent screen sections at opposite ends. Vertical rods 42 project through aligned holes 44 of the links 36. As best seen in FIG. 3, the headed ends 36*a* for the individual horizontal links 36 are of disc form to facilitate the positive rotation of the endless solids diverter screen 30. The endless screen 30 is physically supported by a series of identically formed sprockets indicated generally at 50 which are fixedly mounted to both a vertical driven shaft 52 and a vertical drive shaft 54 at opposite left and right ends of the solids diverter horizontal rotating screen unit 12. The shafts 52, 54 have square cross sections matching square holes 55 within the center of sprockets 50 to insure positive drive between the rotating shafts and the various sprockets 50 mounted thereon. There may be, for instance, five sprockets 50 on each of the shafts 52. Idling or take up sprockets 50 on shaft 52 are identical to driving sprockets 50 on drive shaft 54. However, the idling or take up sprockets have teeth 56 which face in the opposite direction to those of the drive sprockets 50 fixed to the drive shaft 54. The teeth 56 include a near radial edge 58 on one side and a concave edge 60 on the opposite side; the concave edge 60 acting to contact the circular disc form headed ends 36*a* of links 36. In each instance, however, the endless screen 30 drives the sprockets 50 fixed to the driven shaft 52 while, the teeth 56 of the sprockets 50 fixed to the drive shaft 54 function to drive the endless screen 30 by contacting the headed ends 36*a* of respective lengths via teeth concave edges 60 which face in the direction of rotation. In order to lock the various idling or take up sprockets and the various driving sprockets axially at defined positions to driven shaft 52 and drive shaft 54, respectively, these shafts have grooves 62 within their peripheries at longitudinal spaced positions. Grooves 62 receive snap rings 64 to physically locate the sprockets 50 at equally spaced positions along the lengths of the respective shafts 52, 54. As seen in FIGS. 1 and 4, the sprocket arrangement is commercially available under the registered Trademark INTRALOX as are the screen sections 34 making up the endless screen 30**.

Screen 30 may take other forms and sprockets 50 on driven shaft 52 may be replaced by roller idlers.

As may be appreciated by reference to FIGS. 1–5 inclusive, the solids diverter horizontal rotating screen unit 12, is a unitary structural assembly including an elongated frame indicated generally at 64, supporting the endless screen 30 for rotation in the direction of arrow 66 and topped by a drive motor 68 at one end thereof. Motor 68 is coupled to the drive shaft 54 at the end of the unit 12 proximate to grinder 14. The frame 64 includes left and right lower end housings 70, 72, and left and right upper end housing 71, 73, respectively, linked at the top and bottom by adjustable mechanical links indicated generally at 74, 76 the purpose of which is to put proper tension on screen 30 and maintain it during operation.

The solids S within the influent stream 22 tend to follow the laminar flow of diverted influent caused by transverse movement of the upstream face 78 of the upstream length of screen 30, and while most of the influent 22 liquid passes therethrough, the solids S larger than the screen openings are carried along the upstream face 78 of the screen, and are automatically swept from the curved end 30*a* of screen 30 at the narrow channel section 32*a* leading to the grinder unit 14, FIG. 1. The end housings 70, 71, 72, 73 are essentially metal blocks of rectangular form, which mount respective ends of the drive and driven shafts 54, 52. Those shaft ends may be of circular cross section and of reduced diameter, for instance shaft ends 54*a* for drive shaft 54, FIG. 4, are appropriately mounted by anti-friction bearings 80, 82. Similar anti-friction bearings are provided as at 83 for the driven shaft 52, FIG. 1. The sectional view, FIG. 4, shows the lower end housing 72 having a bore 84 and a first counterbore 86, within which is positioned an annular seal assembly 88. Further, an annular ring 90 is bolted to end housing 72 at a further counterbore 92 which receives ring 90. Screws 93 fix the annular ring 90 onto the recessed bottom of end housing 72. Access thereto is covered by the bottom cover 96 via a series of screws 98. The inner periphery of ring 90 underlies the outer race of anti-friction bearing 80 to maintain the lower reduced diameter end 54*a* of the drive shaft 54 mounted for rotation about its vertical axis within lower end housing 72. The right hand end housings 72, 73 are fixedly joined, FIG. 4, by a vertical frame member or bar 94. To effectively seal the lower end of the drive shaft 54, the drive shaft section 54*a* is provided with a circumferential groove receiving an O-ring 99 which acts in conjunction with seals 100 for sealing cavity 102 of end housing 72 interiorly of cover 96. Further, a gasket (FIG. 2) may be provided on the inside face of the cover 96 and between the cover and the lower end housing 72.

The structural arrangement is a near duplicate for the upper end of the drive shaft 54, however, the drive shaft 54 at that end is extended by a first reduced diameter portion 54*a*, and by a second further reduced diameter portion 54*b* which projects through the center of upper cover 106 which overlies the upper end housing 73, at that end of the screen unit 12. As seen in FIG. 4, a flanged cylindrical housing 108 is fixedly mounted to cover 106. Housing 108 carries interiorly a shaft coupling 114 connecting the reduced diameter portion 54*a* of the drive shaft 54, and a further axially aligned output shaft 110 of a speed reducer indicated generally at 112 which is fixed to the upper end of housing 108. Coupling 114 may be a model LO90 commercial coupling, sold under the trademark LOVE JOY. A second LOVE JOY model LO90 coupling 116 couples the speed reducer input shaft 118 to a motor shaft 120 which projects downwardly from drive motor 68. Motor 68 is, in turn, fixedly mounted coaxially above the speed reducer 112, via a further flanged, open housing 124. The speed reducer 112 effectively reduces the RPM of the motor shaft 120 to an acceptable speed for rotating drive shaft 54 and moving the screen 30 slowly, so that the solids S of a size larger than the mesh openings or holes 40 within the endless screen 30, are maintained within the laminar flow of influent along the upstream vertical face 78 thereof. The solids traverse the screen unit 12 to the point where, an accelerated portion of an solids influent stream 22 diverted by screen 30 flows into the narrow channel portion 32*a* between the right hand end of the screen unit 12 and sidewall 18 of the chute 20. In accelerating past the screen, the influent stream carries the solids S in particle form and projects them into the inlet port of grinder unit 24. Insofar as driven shaft 52 is concerned, the sprockets 50 thereon function as idler sprockets and it is the rotation of the endless screen 30 which drives the driven shaft 52 in a counterclockwise direction, FIG. 1.

Figure 2:
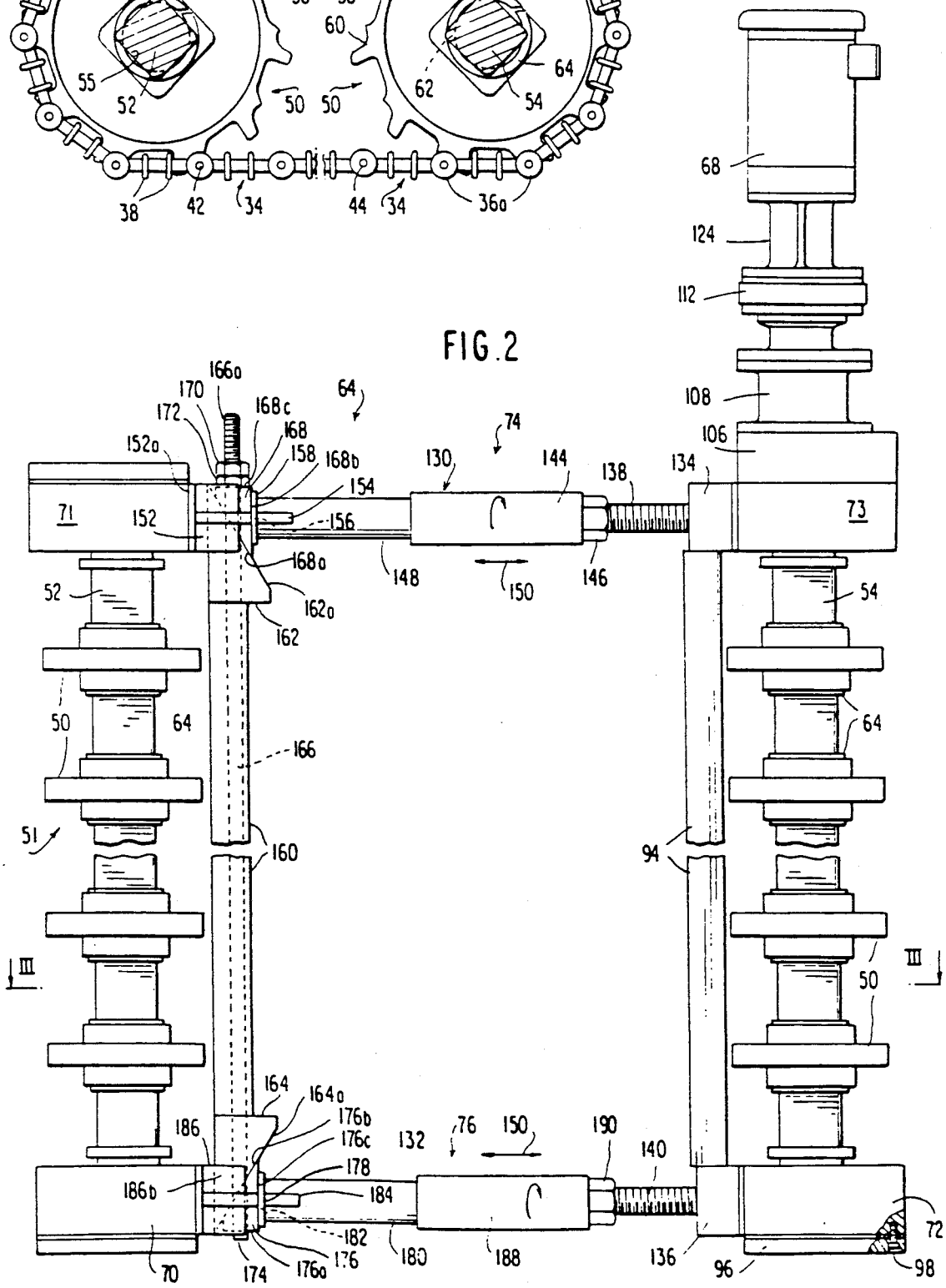
FIG. 2 is a front elevational view of the horizontal rotating solids diverter screen unit employed in the apparatus of FIG. 1.

Driven shaft sprocket assembly 51, comprising driven shaft 52 and a series of sprockets 50 about which endless screen 30 wraps, is physically coupled to drive shaft sprocket assembly 53, similarly formed by drive shaft 54 and sprockets 50, by the upper and lower mechanical links 74, 76, respectively, including upper and lower primary tensioners 130 and 132. In that respect, the vertical frame member or bar 94, FIG. 2, is fixed at its upper and lower ends to the drive end housings 72, 73 by flanges 134, 136 from which project threaded shafts 138, 140, respectively. The upper primary tensioner 130 comprises an internally threaded, hollow sleeve 144 which threadably receives the end of the threaded rod 138. Threaded rod 138 bears a locknut 146. By rotating sleeve 144 which rotatably mounts extension rod 148, coaxial therewith, the sleeve 144 is caused to shift axially in the direction the of the double headed arrow 150 in a direction determined by whether sleeve 144 is rotated clockwise or counterclockwise about its axis. A pair of right angle brackets 152, fixed to the upper, left end housing 71, are of L-shaped configuration having their bases 152*a* flush with the side of the end housing 71. Further projecting outwardly from the base 152*a* are paired circular bars or studs 154 which slidably pass through holes 156 within a plate 158 which is welded to the end of extension rod 148. Further, a U-shaped channel bar 160 extends vertically parallel to the driven shaft 52, and has upper and lower wedges 162, 164, fixed respectively to opposite ends thereof. Wedge 162 is narrower than the bracket 152 within which the wedge 162 is positioned, with an oblique face 162*a* of wedge 162 facing away from end housing 71. Further, a metal rod 166 of a length in excess of the length of channel bar 160 extends the length of the channel bar 160 and is positioned internally, with a slot or bore of the same and has ends passing through narrow slots within wedges 162, 164. Slidably mounted on the oblique face 162*a* of wedge 162 is a sliding block indicated generally at 168 having a contacting oblique face 168*a* which matches an oblique face 162*a* of wedge 162. Further, the sliding block 168 is of a corresponding width to the wedge 162 and is positioned between projecting rods 154. Block 168 also has a vertical face 168*b* which lies flush to plate 158. The upper end of the rod 166 is threaded and threadably carries, in order, an adjusting nut 170 and a locknut 172, with adjustment nut 170 abutting a flat, horizontal face 168*c* of sliding block 168.

At the lower end of the threaded rod 166 and in conjunction with left end housing 70, a duplicate assembly is provided including wedge 164. The rod 166, at its lower end, need not be threaded and has a right angle bar 174 welded at its center to the end of the rod, so that bar 174 underlies a horizontal bottom face 176*a* of a sliding block indicated generally at 176. Block 176 includes an oblique upper face 176*b* which abuts a similarly angled oblique face 164*a* of wedge 164. The sliding block 176 includes a vertical face 176*c* which abuts a plate 178 welded to the end of an extension rod 180 of the lower primary tensioner 132. Further, the plate 178 is apertured at both sides at 182 to receive the projecting ends of studs or bars 184 which project outwardly from base 186 of a pair of respective L-shaped brackets 186 whose side plates 186*b* contact respective sides of lower wedge 164 and sliding block 176 of the lower primary tensioner 132. The lower primary tensioner 132 includes a sleeve 188 which rotates about its axis relative to connecting rod 180 at one end and which is internally threaded at its opposite end to the end of the threaded rod 140 which projects from and is fixed at its other end to lower drive end housing 73. Threaded rod 140 bears a locknut 190, so that the position of the sleeve 188 on threaded shaft 140 can be fixed via locknut 190, once the lower primary tensioner 132 is adjusted to initially fix the position of the driven shaft sprocket assembly 51 relative to the drive shaft sprocket assembly 53. The rod 166 which is threaded at its upper end, as at 166*a*, is effective to maintain coupling between the upper sliding block 168 and the lower sliding block 176 in contact with respective wedges 162, 164, and at the same time maintaining an effective coupling via studs 154, 184 and the plates 158, 178 fixed to connecting rods 148, 180 of respective primary tensioners 130, 132, between drive shaft sprocket assembly 53 and driven shaft sprocket assembly 51. After primary tension is set up in the endless screen 30 through the two primary tensioners 130, 132, the locknut 172 is loosened and the adjustment nut 168 tightened down the effect of which is to drive wedges 162, 164 to the left, FIG. 2, along with the balance of the driven shaft sprocket assembly 51 to finalize the tension within endless screen 30. Preferably, the primary tensioners 130, 132 are set before the screen unit 12 is lowered into the channel 32 of the chute or spillway 20, while the single secondary tensioner 151, comprising principally sliding blocks 168, 176 and rod 166, is used for further adjustment of the screen tension, after the solid waste treatment system 10 and in particular, the horizontal rotating solids diverter screen unit 12 is installed within the channel 32. It is noted, that secondary tension of screen 30 and final adjustment thereof, may be effected by ready access to the threaded upper end 166*a* of rod 166, with this end of the rod projecting above the level of the influent stream 22 entering the channel 32 within which the unit 12 is mounted. The secondary tensioner may be eliminated if desired and tension in the screen 30 preset prior to mounting the screen unit 12.

In order to effect the mounting of screen unit 12 as well as the grinder unit 14 with the vertical screen 30 moving horizontally across and at right angles to the direction of flow of the solids influent 22, an open frame is required for mounting these two elements of the assembly 8. Since the solids diverter horizontal rotating screen unit 12 constitutes a unitary structure and separate subassembly from that of grinder unit 14, it is useful to have an open frame assembly 190 physically embrace the upper end housings 71, 73 of screen unit 12 and a similar upper end housing of grinder unit 14 and that the lateral distance between sidewalls 16, 18 of the chute or spillway 20 be slightly in excess of the overall length of the unit 12. As shown in FIG. 1, frame assembly 190 comprises laterally spaced metal mounting plates 192, 194 fixed to the chute or spillway sidewalls 16, 18 by lag screws or the like at 196. Fixedly mounted and joined at opposite ends to plates 190, 194 are a downstream frame member 198 and an upstream frame member 200. Members 198, 200 may be L-shaped angle bars or U-shaped channel bars. The distance between channel bars 198 and 200 is equal to the width of screen unit end housings 71, 73, so that the end housings 71, 73 snugly fit between these two members.

It is preferred that the solid waste treatment assembly 8 include some means such as an oblique baffle plate or wall 202 be positioned vertically, at an oblique angle to the diverted influent stream and having an upstream vertical edge connected to the downstream edge of respective drive shaft end housings 72, 73 at the right end of screen unit 12 and its downstream edge coupled to an angle bar 210 to one side of inlet port 221 of grinder unit 14, so as to baffle the flow of influent 22 with the solids S towards the upstream inlet port 221 of the grinder unit 14 as described hereinafter. A generally parallel baffle plate 203 may be placed vertically with its upstream edge contacting chute side wall 18 and its downstream edge contacting the upstream angle bar 210 proximate to sidewall 18 to control the flow of solids into inlet port 221.

Appropriately, a flat vertical sheet metal wall or plate 204 extends vertically upwardly from the bottom wall of the chute or spillway 20, is fixed at one end to the short length angle bar 206, and is fixed at its opposite end to angle bar 208 which spans between plate 204 and plate 194 being appropriately welded or otherwise mechanically fixed thereto by means of bolts, rivets, etc.

In all, four right angle L-shaped cross section angle bars 210 extend vertically downwardly from respective plates 204, 194 to the bottom wall of the chute, defining a rectangular open frame enclosure 211 for grinder unit 14 of the waste treatment system. Further, this portion of the open frame assembly 190 does not hamper the flow of solids influent 22 and indeed facilitates the acceleration of a portion of the influent 22 flow stream as its sweeps through the narrow vertical channel portion 32*a* between plate 194 and sidewall 18, and the end 30*a* of the endless screen 30 wrapped under tension about the sprockets 50 of the drive shaft 54 of screen unit 12.

Preferably, metal bars or supporting ways 79 are fixedly mounted at opposite ends to vertical frame members or bars 94, 160 at vertically spaced positions and extend horizontally behind the upstream length of screen for supporting the front half of the screen loop as it is driven by drive shaft 54.

Figure 5:
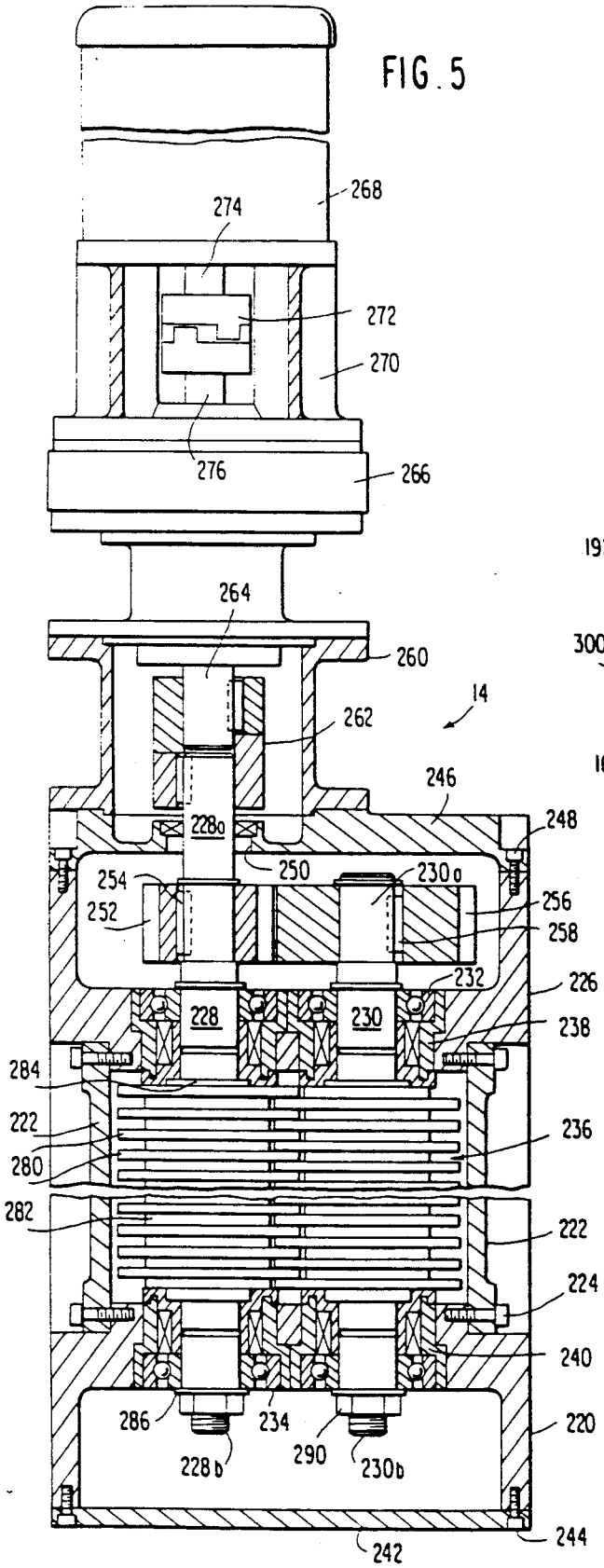
FIG. 5 is a front elevational view, partially in section of the grinder unit forming a principal component of the solid waste handling system illustrated in FIG. 1.

The makeup and nature of operation of the grinder unit 14 may be seen by reference to FIG. 5 which is a vertical sectional view of the grinder taken about line V—V of FIG. 1 as well as from the content of U.S. Pat. No. 4,046,324, whose content is incorporated herein by reference.

The grinder unit 14 consists of a vertically stacked assembly corresponding in general to that of the stacked drive shaft sprocket assembly 53, with the exception that a drive shaft 228 of unit 14, FIG. 5, rotates a first set of shredding members fixed to the shaft 228, which shaft is in line with and coupled to a drive motor 268, while a second drive shaft 230, parallel thereto is mounted for rotation about its vertical axis and is geared to the first drive shaft and which fixedly mounts further interengaging shredding members.

Specifically, the grinder unit 14 comprises a lower end housing 220 of cast or machined metal which is coupled via a pair of oppositely disposed, laterally spaced side rails 222 via screws 224, at upper and lower ends thereof, to an upper end housing 226. The upstream and downstream faces of unit 14 between the upper and lower end housings 226, 220 are open and define, respectively an inlet port 221 and an outlet port 223 to permit the influent 22 bearing the solids S to pass through the grinder unit 14. In that respect, additionally, the interiors of the hollow end housings are sealed from the shredding area, indicated generally at 236 between laterally spaced side rails 222, by upper and lower seal assemblies 238 and 240 for respective shafts 228, 230. A bottom cover 242 underlies the lower end of the lower end housing 222 and is coupled thereto by screws 244. Similarly, a top cover 246 is fixedly mounted to the upper end housing 226 via screws 248 and is provided with a circular opening or hole 250 through which a reduced diameter section 228*a* of drive shaft 228 passes.

Mounted to the top cover 246 is a cylindrical spool 260, within which is housed a first shaft coupler 262 which couples the reduced diameter portion 228*a* of shaft 228 to an output shaft 264 of a speed reducer 266 coaxial with the first shaft coupler 262. The speed reducer 266 functions to reduce the speed of a drive motor 268 which tops the assembly and which is physically mounted to an open frame 270 interposed between motor 268 and speed reducer 266 and coaxial therewith. Coupling between the motor 268 and the speed reducer 266 is effected by a second shaft coupler 272 which connects at its upper end to the motor shaft 274 and at its lower end to input shaft 276 of the speed reducer.

Each of the shafts 228, 230 support, in alternately stacked fashion, radially enlarged cutting elements 280 and smaller diameter spacers 282, the cutting elements being of disc form and having radially projecting cutting teeth. The cutting elements 280 are of laminar form, generally of equal thickness to those of the laminar form spacers 282. A laminar spacer of one shaft 228 is coplanar with a cutting element on the other shaft 230 with the cutting element of one stack and the spacer of the other stack together forming a pair of interactive shredding members. The solids S within the flow stream 22 passing in the direction of the arrows and carried by the liquid influent, are shredded to a fine degree by the high speed rotating, stacked, interacting shredding members on respective shafts 228, 230. The fine solid particles exit from the downstream outlet port 223 of the grinder unit 14 as a waste stream effluent 24 characterized by very fine solids particle content.

In maintaining the assembly of stacked cutting elements 280 and spacers 282 on respective shafts, the shafts are provided with circular discs 284 which abut respective upper bearing assemblies 232, while washers 286 at the lower end of respective shafts 228, 230 clamp against the lower bearing assemblies 234. Further, the respective shafts 228, 230 have reduced diameter externally threaded lower ends 228*b*, 230*b* which ends carry locknuts 290 which by axial adjustment, cause a desired compressive force to be exerted on the stacked cutting elements 280 and spacers 282 of respective shafts.

In operation, upon energization of respective motors 68 of the screen unit, and 268 of the grinder unit, solids reaching the the upstream face 78 of the rotating endless screen 30 of a size in excess of the mesh of that screen, are carried by diverted influent along on the screen 30 as it revolves clockwise, FIG. 1, with a significant portion of the liquid influent stream 22 passing through the perforated screen. However, since the grinder unit 14 is offset downstream in the direction of influent 22 flow and since the end of the screen unit 12 is spaced a short distance from sidewall 18, the flow stream is accelerated as it passes by the right hand lateral edge of the unit 14 and enters narrow channel portion 32*a*, automatically diverting the solids S away from the screen as the screen 30 wraps about the sprockets 50 mounted to screen unit drive shaft 54. The diverted influent 22 with the heavy concentration of solids S passes via narrow channel portion 32*a* into the inlet port 221 of the grinder unit 14 where the solids are rapidly and effectively ground into fine particles during passage through the stacks of shredders carried by respective shafts 228, 230. The grinder unit 14 a waste stream effluent indicated by arrow 24, FIG. 1 discharges through the outlet port 223 of unit 14.

It is apparent from the description to this extent, that the grinder unit 14 and the screen unit 12 make an effective structural assembly 8 with the offsetting of the screen unit 12 and the grinder unit 14 being such that there is an acceleration of the flow stream around the end of the screen to selfdivert the solids S away from screen end 30*a* into the inlet port of the grinder unit 14. Further, with the solids S upon being ground up, placed back into the waste stream, this eliminates the necessity of the prior practice of physically removing the solids for separate processing, principally effected by vertical rakes which clean off the solids by raising them from the flow stream above the level of that stream and into a further transport system above the level of a fixed vertical screen, normally comprised of vertically oriented bars in laterally spaced, parallel position. Significant economies result from the structural combination of the horizontal rotating screen unit 12 and the grinder unit 14 in the manner of the illustrated embodiment, FIG. 1, and the other embodiments described hereinafter.

Figure 7:
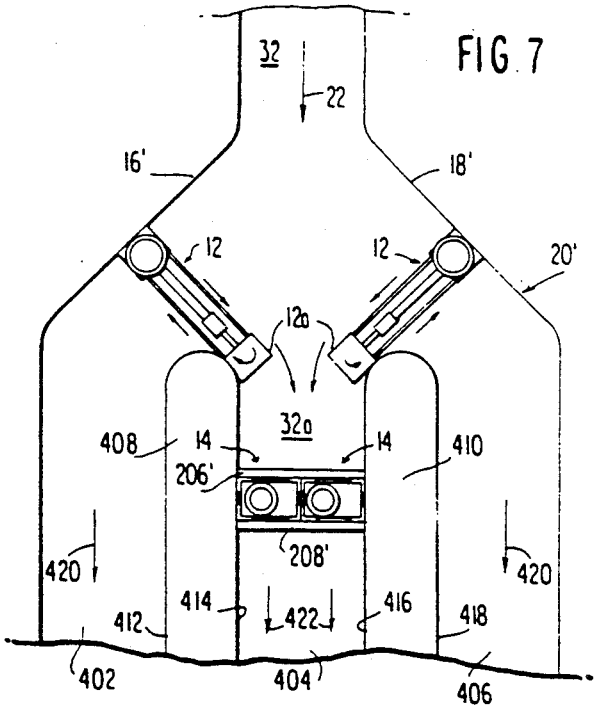
FIG. 7 is a top plan view of a solid waste handling system forming yet another embodiment of the present invention.
Figure 8:
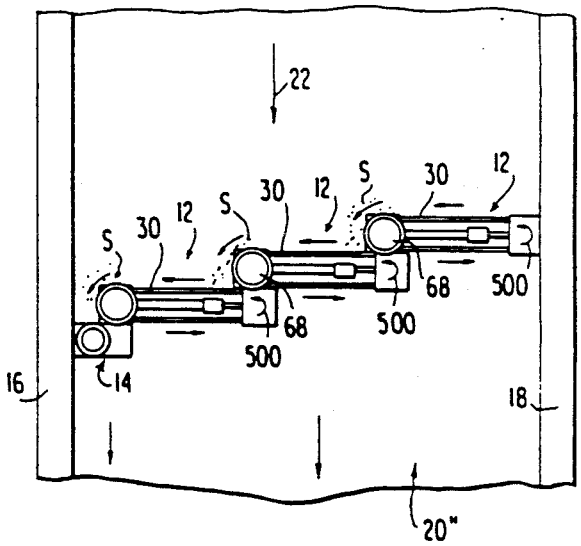
FIG. 8 is a top plan view of a solid waste handling system forming yet a further embodiment of the present invention.
Figure 6:
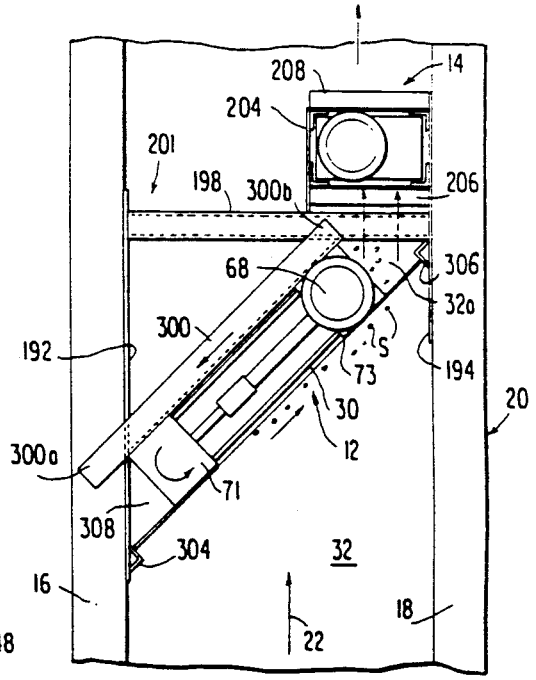
FIG. 6 is a top plan view of a solid waste handling system forming a second embodiment of the present invention.

FIGS. 6, 7 and 8 show preferred alternate embodiments of the invention. In these alternate embodiments, like numerals are employed for like elements.

In referring to FIG. 6, the chute or spillway 20 which consists of laterally spaced walls 16, 18 is somewhat narrower than the spillway 20 of the embodiment of FIG. 1. In order for proper acceleration of the influent stream 22 to the end of the screen unit 12, proximate to sidewall 18 but spaced from that sidewall so as to create a narrow channel portion 32*a*, the screen unit 12 must be angulated and other than perpendicular to the influent stream 22. In this case, the transverse frame support member or channel bar 198 is maintained at the same position extending between plates 192 and 194 fixed to respective sidewalls 16, 18 and the method of fixedly mounting the grinder unit 14 by way of angle bars 206, 208, and vertical plates 204, 194, etc. is identical to the embodiment of FIG. 1.

A change is effected by means of an oblique angle bar 300 which is fixedly mounted with one end 300*a* overlying the top of the sidewall 16, while its opposite end 300*b* overlies the top of transverse channel bar 198 and which may be welded, screwed, bolted or otherwise fixed at respective ends to these members. The open frame assembly 190' of this embodiment is completed by a metal bar or strip 302 which is fixed to the opposite side of screen unit 14 at respective end housings 71, 73 and which extends beyond these housings. Brackets 304, 306 may be welded or otherwise fixed to plates 292, 294 and strip 302 may be suitably fixed at its opposite ends to brackets 304, 306 by being integrated to the brackets during manufacture, or welded, bolted, etc. at its ends thereto.

Further, it should be kept in mind that, while open frame assembly indicated generally at 190' defined by frame members 198, 300 and 302 is effected above the level of the solids influent stream 22 and defines between parallel bars 300, 302, a slot 308 within which the screen unit 14 is positioned, similar open frame support members may be positioned within the bottom of the chute or spillway 20 to facilitate fixed positioning of the lower end of the screen unit 14. Open frame support members at the bottom of the chute or spillway 20 would correspond to that illustrated in FIGS. 1 and 6 for reception and locking of a lower end of the grinder unit 14 as a mirror image of those employed by frame assembly 190', in fixing the upper end of grinder unit 14. The same is true for the other embodiments herein.

In the embodiment of FIG. 6, with the angulation of the screen unit 14, the downstream, left corner of the screen unit 14 abuts the surface of plate 192 (or the inside surface of sidewall 16 of the chute 20), so that some influent 22 flow is diverted, which must pass through the horizontal, rotating endless screen 30 of unit 14 with the solids S larger than the mesh size of screen 30 carried by the diverted influent along the surface of the screen. The solids S are swept by the accelerating portion of influent stream 22, when it passes through the narrow channel portion **32*a* leading to the inlet port of grinder unit 14**.

In FIG. 7, the chute or spillway 20' divides into three, parallel outlet passages or channels 402, 404 and 406, with the solids influent stream 22 expanded by diverging sidewalls 16', 18' of chute 20'. A pair of separators 408, 410 define further vertical sidewalls 412, 414, 416 and 418 creating, with sidewalls 16' and 18', the respective outlet channels 402, 404 and 406. The waste treatment system of this embodiment utilizes two screen units 12, 12 which are fixed to the diverging chute walls 16', 18' and which extend at right angles thereto having ends at **12*a* which are separated from each other forming a narrow channel portion 32*a'* therebetween through which portion, the solids S influent stream 22 pass at accelerated velocity leading to the upstream inlet ports 221 of a pair of side by side grinder units 14, 14 which occupy the lateral width of the central outlet channel 404. In this embodiment, L-shaped frame members such as channel bars or angle bars 206' and 208' have ends fixed to respective sidewalls 414, 416, and define a narrow slot within which the two grinder units 14 are positioned side by side. In FIG. 7, the open frame support assemblies near the top of the chute 20' are not illustrated for mounting screen units 12, but are preferably employed for fixing the position of screen units 12, 12 which span the full gap between the spacers 408, 410 and the respective sidewalls 16', 18' of chute 20'. In this case, the effluent streams 420 passing through outlet passages 402, 406 are free of solids S, while finely ground solids S are discharged from grinder units 14, 14 for passage through the center outlet channel 404 of the waste treatment system as part of effluent stream 422**.

Depending upon the capacity of the grinder unit 14, and the lateral width of the channel through which the solids influent stream 22 passes, a number of stacked horizontal, rotary screen units may be employed in tandem, successively offset downstream, with the solids S larger than mesh size of the endless screens 30 of each screen unit 12 being swept along the upstream screen unit to the succeeding downstream screen unit and finally flow diverted by the accelerating influent stream through a narrow channel portion **32*a* between the most downstream screen unit 12 and the adjacent chute sidewall, into the inlet port 221 of the further offset, downstream grinder unit 14, as seen in the embodiment of FIG. 8**.

In this embodiment, the chute 20'' has its sidewalls 16, 18 separated by a distance which is in excess of the overall length of three screen units 12 when positioned in end overlapping, downstream offset stacked position with respect to the flow of the influent stream 22 and at right angles to flow direction. The direction of rotation of the drive motors 122 for the screen units 12, are such as to cause screens 30 to rotate in the same counterclockwise direction, FIG. 8. Thus, the solids S in particle form, are swept by the diverted portion of influent stream 22 away from the ends **30*a* of the rotating screens 30 to move towards the upstream face of the endless screen 30 of each succeeding unit from right to left, FIG. 8, and with a final concentration of the solids S within that diverted portion of the influent stream 22, within channel portion 32*a* leading directly to the inlet port 221 of the single grinder unit 14. Grinder unit 14 has one end fixed to wall 16 and the other end underlies the end of most downstream screen unit 12 of the assembly. Again, in FIG. 8, the representation is one which is schematic, and the open frame support assembly for supporting the various screen units 12 and grinder units 14 is purposely not shown, but consists of appropriate frame members formed by metal channel bars or the like, and is constructed so that various shaped channel bars are preferably fixed at respective ends to the opposing sidewalls of chute 20'. The direction of screen rotation is indicated by arrows 500**.

From the above description it may be seen that a very effective waste handling system is developed on the basis of an assembly of at least one screen unit and at least one grinder unit with the horizontal rotating screen continuously diverting solids from the waste stream directly into the grinder unit with both units being easily installed having motors above the influent stream and dropped into position within a chute carrying the influent stream carrying the solids by dropping the units in place within a open frame support assembly. The vertically oriented grinder unit or units grind solids into uniformly small particles minimizing damage to pumps and other processing equipment. The screen unit, like the grinder unit, is of simple design, rugged construction with few moving parts thereby minimizing maintenance and repair cost as well as down time. The horizontal rotating screen is self-cleaning using the accelerated diverted portion of the influent stream to wash the captured solids particles off the upstream face and accelerate the flow thereof and concentration into the inlet port of the grinder unit. Further, the close mesh of the screen keeps all unwanted particles that could cause downstream clogging problems.

As may be appreciated, simple modifications may be made to permit the screen units 12 and the grinder units 14 to operate fully submersed in the influent stream.

The electric drive motors may be of the hermetic type with appropriate sealed electric cables, alternatively, hydraulic drives may be employed for submersible application using hydraulically driven rotary motors for rotating the drive shafts of respective units. Depending upon the size and mass of the solids, some solids may actually contact the screen 30, however, the solids tend to follow the laminar flow caused by the screen moving towards the grinder unit rather than impacting on the screen. As may be appreciated, while a screen of particular construction is disclosed in detail, open mesh screens in the form of endless loops appropriately sized may replace the screen made up of sections and principally of molded plastic links, without departing from the scope of the invention. Further, tracking discs may be added to drive shaft 54 to prevent the screen from mis-tracking, and while baffle plates have been provided between the downstream of said grinder unit or units and the upstream screen units at the end adjacent to the grinder units to prevent damage to the screen from objects being kicked back from a reversing grinder unit during reverse operation and to eliminate dead spots where solids can collect, the particular bafflet plates are exemplary only of one type of baffling to facilitate the feed of solids entrained within the influent stream into the upstream inlet port of the grinder unit and different screens may be employed for utilizing one or more vertically upright baffle plate to perform that function.

It is, of course, understood that various changes and modifications may be made in the details in construction and design of the above specifically described embodiments of this invention without departing from the spirit thereof, such changes and modifications being restricted only by the scope of the following claims.

What is claimed is:

1. A solid waste handling system for screening and grinding solids entrained in an influent liquid stream flowing within a flow confining chute, said chute having a bottom wall and laterally spaced vertical sidewalls defining a flow channel for said stream, said system comprising:

at least one rigid solids diverter horizontal rotating screen unit fixedly mounted within said chute and partially immersed in said influent liquid stream, said at least one rigid screen unit comprising an elongated open rigid frame assembly, an endless loop open screen mounted for rotation on said rigid frame assembly such that one upstream face of the screen moves horizontally across the stream, means for rotating said screen on said rigid frame to divert a portion of the stream flow in the direction of screen movement, to cause solids of the influent stream larger than a mesh size of the screen to impact upon said one upstream face and be moved horizontally in the direction of screen movement, and a solid waste grinder fixedly mounted within the flow stream and downstream of the endless loop screen, whereby solids entrained in the diverted portion of the influent stream are conveyed to an end of the screen proximate to said solid waste grinder, swept away from the screen by the diverted flow of influent passing over the end of the screen, and finely ground prior to discharge through an outlet port of said at least one solid waste grinder as waste effluent, wherein said screen unit open frame assembly comprises left and right, vertically spaced, upper and lower end housings, vertically oriented drive and driven shafts mounted for rotation about their axes at opposite ends within respective upper and lower end housings, a plurality of sprockets fixedly mounted to said shafts for rotation about their axes at axially spaced positions along said shafts, said drive shaft and said sprockets mounted thereto defining a drive shaft sprocket assembly and said driven shaft and the sprockets mounted thereto defining a driven shaft sprocket assembly, said sprockets including radially projecting teeth, and wherein said endless loop open mesh screen comprises linked screen sections, each screen section being formed of a plurality of horizontal, vertically spaced links having enlarged headed ends, horizontally spaced vertical riser strips integral with said links to define with the links, rectangular screen mesh openings, and wherein the headed ends of the horizontal links of adjacent screen sections have axial holes and said headed ends are interposed with each other with the holes thereof aligned and rods projecting through said aligned holes and pivotably coupling said links together at said headed ends such that said pivotably coupled screen sections wrap about said drive shaft and driven shaft sprocket assemblies at respective ends of said screen units with the headed ends of said links engaging said sprocket teeth.

2. The solid waste handling system as claimed in claim 1, wherein said sprocket teeth have concave grooves within one side of the teeth facing in the same circumferential direction, and wherein the sprockets fixed to the drive shaft have the teeth thereof facing oppositely to those of the sprockets fixed to the driven shaft, whereby one of said shafts functions as a drive shaft and the other as an idler.

3. The solid waste handling system as claimed in claim 1, herein the bottom of said screen unit lower end housing and the top of said screen unit upper end housing are closed off by respective bottom and top covers, said top cover of said upper end housing bearing said drive shaft is centrally apertured, said drive shaft includes a shaft extension portion projecting through said top cover aperture, and wherein said upper end housing rotatably supporting said drive shaft has, stacked thereon and above the top cover, a speed reducer and a drive motor in that order, and wherein a pair of shaft couplers are interposed, respectively between the motor and the speed reducer and the speed reducer and said screen unit drive shaft for completing a speed reduction drive coupling between an output shaft of the motor, and said screen unit drive shaft.

4. The solid waste handling system as claimed in claim 1, wherein said screen unit open frame assembly includes an upper tensioner operatively coupled between the upper end housings for said drive shaft and driven shaft sprocket assemblies and a lower tensioner operatively coupling the lower end housings for said drive shaft and driven shaft sprocket assemblies to effect selective adjustment of the tension of the endless loop screen rotatably mounted on said drive shaft and driven shaft sprocket assemblies.

5. The solid waste handling system as claimed in claim 4, further comprising a secondary tensioner interposed between the upper and lower tensioners and the driven shaft sprocket assembly, said secondary tensioner including secondary tensioner adjusting means in juxtaposition to the upper end housing of said driven shaft sprocket assembly for effecting adjustment of the secondary screen tension after the screen unit is mounted within said chute.

6. The solid waste handling system as claimed in claim 5, wherein said screen unit open frame assembly comprises a vertical frame member fixedly interposed between the upper and lower end housings of said drive shaft sprocket assembly and extending parallel to said drive shaft, each of said upper and lower tensioners comprises threaded rods fixedly mounted respectively to upper and lower end housings of drive shaft sprocket assembly and projecting at right angles to the drive shaft towards, and being aligned with the upper and lower end housings of said driven shaft sprocket assembly, an internally threaded sleeve threadably coupled to the end of each of said threaded rods remote from said drive shaft sprocket assembly end housings and movable axially towards and away from said drive shaft sprocket assembly upper and lower end housings, a locknut threadably mounted to each threaded rod for locking said sleeve at an axially adjusted position, and wherein each of said sleeves further comprises a connecting rod mounted coaxially to said sleeve for relative rotation thereto and operatively coupled at an end remote from the sleeve to the respective upper and lower end housings of said driven shaft sprocket assembly such that upon rotation of the sleeves of the upper and lower tensioners, the upper end housings and the lower end housings are moved towards and away from each other to effect primary tensioning to the screen carried by the sprockets of the screen unit drive and driven shaft sprocket assemblies.

7. The solid waste handling system as claimed in claim 6, wherein said secondary tensioner comprises a channel member, fixedly mounted to the upper and lower end housings of said driven shaft sprocket assembly and fixedly mounting triangular shaped wedges at opposite ends thereof facing the connecting rods of the upper and lower tensioners, an adjusting rod extending through said upper and lower wedges, triangular shaped sliding blocks mounted on opposite ends of said secondary tensioner rod, said sliding blocks having oblique faces in contact with oppositely oblique faces of respective wedges and in operative contact with respective ends of said connecting rods and means for causing said sliding blocks to move towards and away from each other on said secondary tensioner adjusting rod and to thereby shift the upper and lower end housings of said driven shaft sprocket assembly towards and away from the connecting rods of said upper and lower tensioners to effect secondary tensioning of the screen wrapped about the sprockets of said drive and driven shaft sprocket assemblies.

8. The solid waste handling system as claimed in claim 7, wherein studs are fixedly mounted to opposite sides of said wedges and project past opposite sides of said sliding blocks through apertured plates fixedly mounted, respectively to the ends of the connecting rods remote from the rotatable sleeves of said upper and lower tensioners and abutting said sliding blocks so as to maintain the sliding blocks in oblique face abutment with said respective upper and lower wedges, and wherein said secondary tensioner adjustment rod includes a cross bar fixed to the lower end thereof and underlying the bottom of the lower sliding block and said secondary tensioner adjusting rod extends through aligned slots within said wedges and said sliding blocks, and has a threaded upper end projecting above an upper face of said upper sliding block, and an adjustment nut threaded to the upper threaded end of said secondary tensioner rod and bearing on said sliding block such that tightening down on said adjustment nut causes said sliding blocks to move towards each other on respective wedges, and to drive said driven shaft sprocket assembly away from said drive shaft sprocket assembly to permit tension adjustment within said endless loop screen after installment of the screen unit within said chute.

9. A waste handling system for screening and grinding solids entrained in an influent liquid stream flowing within a flow containing chute, comprising: a solid waste grinder unit; a solids diverter horizontal rotating screen unit fixedly mounted within the chute, comprising an elongated rigid open frame assembly, and endless loop open mesh screen mounted for rotation on said frame assembly such that one face of the screen may be positioned vertically for movement horizontally across the stream and facing upstream thereof, and means for rotating the screen on the rigid frame assembly for diverting a portion of the stream flow in the direction of screen movement to cause solid waste of the influent stream larger than the mesh size of the screen to be entrained in influent diverted along said one upstream face and to be carried thereby in the direction of screen movement such that the solid waste is driven to the grinder unit and finely ground prior to discharge from the grinder unit as waste effluent, wherein said screen unit open frame assembly comprises left and right, vertically spaced, upper and lower end housing, vertically oriented drive and driven shafts mounted for rotation about their axes at opposite ends within respective upper and lower end housings, a plurality of sprockets fixedly mounted to said shafts for rotation about their axes at axially spaced positions along said shafts, said drive shaft and said sprockets mounted thereto defining a drive shaft sprocket assembly and said driven shaft and the sprockets mounted thereto defining a driven shaft sprocket assembly, said sprockets including radially projecting teeth, and wherein said endless loop open mesh screen comprises linked screen sections, each screen section being formed of a plurality of horizontal, vertically spaced links having enlarged headed ends, horizontally spaced vertical riser strips integral with said links to define with the links, rectangular screen mesh openings, and wherein the headed ends of the horizontal links of adjacent screen sections have axial holes and said headed ends are interposed with each other with the holes thereof aligned and rods projecting through said aligned holes and pivotally coupling said links together at said headed ends such that said pivotally coupled screen sections wrap about said drive shaft and driven shaft sprocket assemblies at respective ends of said screen units with the headed ends of said links engaging said sprocket teeth.

10. The solids diverter horizontal rotating screen unit as claimed in claim 9, wherein said sprocket teeth have concave grooves within one side of the teeth facing in the same circumferential direction, and wherein the sprockets fixed to the drive shaft have teeth facing oppositely to those fixed to the driven shaft, whereby one of the shafts functions as a drive shaft and the other as an idler.

11. The solids diverter horizontal rotating screen unit as claimed in claimed 9, wherein the bottom of the screen unit lower end housings and the top of said screen unit upper end housings are closed off by respective bottom and top covers, said top cover of said upper end housing bearing said drive shaft is centrally apertured, said drive shaft includes a shaft extension portion projecting through said top cover aperture, and wherein said upper end housing rotatably supporting said drive shaft has, stacked thereon and above the top cover, a speed reducer and a drive motor in that order, and wherein a pair of shaft couplers are interposed, respectively between the motor and the speed reducer and the speed reducer and the screen unit drive shaft for completing a speed reduction drive coupling between and output shaft of the motor and said screen unit drive shaft.

12. The solids diverter horizontal rotating screen unit as claimed in claim 9, wherein said screen unit open frame assembly includes an upper tensioner operatively coupled between the upper end housings for said drive shaft and driven shaft sprocket assemblies and a lower tensioner operatively coupling the lower end housings for said drive shaft and driven shaft sprocket assemblies to effect selective adjustment of the tension of the endless loop screen rotatably mounted on said drive and driven shaft sprocket assemblies.

13. The solids diverter horizontal rotating screen unit as claimed in claim 12, further comprising a secondary tensioner interposed between the upper and lower tensioners and the driven shaft sprocket assembly, said secondary tensioner including secondary tensioner adjusting means in juxtaposition to the upper end housing of said driven shaft sprocket assembly for effecting adjustment of the secondary screen tension after the screen unit is mounted within said chute.

14. The solids diverter horizontal rotating screen unit as claimed in claim 13, wherein said screen unit open frame assembly comprises a vertical frame member fixedly interposed between said upper and lower end housings of said drive shaft sprocket assembly and extending parallel to the drive shaft, each of said upper and lower tensioners comprises threaded rods fixedly mounted, respectively to said upper and lower end housings of said drive shaft sprocket assembly and projecting at right angles to the drive shaft, and being aligned with the upper and lower end housings of said driven shaft sprocket assembly, an internally threaded sleeve threadably coupled to the end of said threaded rod remote from said drive shaft sprocket assembly end housings and movable axially towards and away from said driven shaft sprocket assembly upper and lower end housings, a locknut threadably mounted to each threaded rod for locking said sleeve at an axially adjusted position, and wherein each of said sleeves further comprises a connecting rod coaxially coupled at one end to the sleeve for relative rotation thereto and operatively coupled at an end remote from the sleeve to the respective upper and lower end housings of said driven shaft sprocket assembly such that upon rotation of the sleeves of the upper and lower tensioners, the upper and lower end housings are moved axially towards and away from each other to effect primary tensioning to the screen carried by the sprockets of the screen unit drive and driven shaft sprocket assemblies.

15. The solids diverter horizontal rotating screen unit as claimed in claim 14, wherein said secondary tensioner comprises a channel member fixedly mounted to the upper and lower end housings of said driven shaft sprocket assembly and fixedly mounted triangular shaped wedges at opposite ends thereof, said wedges facing, respectively, the connecting rods of the upper and lower tensioners, a secondary tensioner adjusting rod, triangular shaped sliding blocks mounted on opposite ends of said secondary tensioner adjusting rod, said adjusting rod having ends extending through said upper and lower wedges, said sliding blocks having oblique faces in contact with oppositely oblique faces of respective wedges and being in operative contact with respective ends of said connecting rods and means for causing said sliding blocks to move towards and away from each other on said secondary tension adjusting rod to thereby shift the upper and lower end housings of said driven shaft sprocket assembly towards and away from the connecting rods of said upper and lower tensioners to effect secondary tensioning of the screen wrapped about the sprockets of the drive and driven shaft sprocket assemblies.

16. The solids diverter horizontal rotating screen claimed in claim 15, wherein studs are fixedly mounted to opposite sides of said wedges and project past opposite sides of the sliding blocks, through apertured plates fixedly mounted, respectively to the ends of the connecting rods remote from the rotatable sleeves of said upper and lower tensioners and abutting said sliding blocks so as to maintain the sliding blocks in oblique face abutment with said respective upper and lower wedges, and wherein said secondary tensioner adjustment rod includes a cross bar fixed to the lower end thereof and underlying the bottom of the lower sliding block and said secondary tensioner adjusting rod extends through aligned slots w thin said wedges and said sliding blocks and has a threaded upper end projecting above an upper face of said upper sliding block and an adjustment nut threaded to the upper threaded end of the secondary tensioner rod and bearing on said sliding block such that tightening down on the adjustment nut causes the sliding blocks to move towards each other on the oblique faces of said wedges and to drive said driven shaft sprocket assembly away from said drive shaft sprocket assembly to permit tension adjustment within said endless loop screen after installation of said screen unit within said chute.

17. A solid waste handling system for screening and grinding solids entrained in an influent liquid stream flowing within a flow confining chute, said chute having a bottom wall and laterally spaced vertical sidewalls defining a flow channel for said stream, said system comprising:

at least one rigid solids diverter horizontal rotating screen unit fixedly mounted within said chute and partially immersed in said influent liquid stream, said at least one rigid screen unit comprising an elongated open rigid frame assembly, an endless loop open screen mounted for rotation on said rigid frame assembly such that one upstream face of the screen moves horizontally across the stream, means for rotating said screen on said rigid frame to divert a portion of the stream flow in the direction of screen movement, to cause solids of the influent stream larger than a mesh size of the screen to impact upon said one upstream face and be moved horizontally in the direction of screen movement, and a solid waste grinder fixedly mounted within the flow stream and downstream of the endless loop screen, whereby solids entrained in the diverted portion of the influent stream are conveyed to an end of the screen proximate to said solid waste grinder, swept away from the screen by the diverted flow of influent passing over the end of the screen, and finely ground prior to discharge through an outlet port of said at least one solid waste grinder as waste effluent, wherein said screen unit open frame assembly comprises left and right, vertically spaced, upper and lower end housings, vertically oriented drive and driven shafts mounted for rotation about their axes at opposite ends within respective upper and lower end housings, a plurality of sprockets fixedly mounted to said drive shaft for rotation about their axes for axially spaced positions along said drive shaft, idler means carried by said driven shaft, said drive shaft and sprockets mounted thereto defining a drive shaft assembly, said driven shaft and said idler means mounted thereto defining drive shaft idler assembly, and wherein said endless loop open mesh screen is looped about respective drive shaft and driven shaft assembly.

18. The solid waste handling system as claimed in claim 17, wherein said screen unit open frame assembly includes an upper tensioner operatively coupled between the upper end housings for said drive shaft and driven shaft assemblies and a lower tensioner operatively coupling the lower end housings for said drive shaft and driven shaft assemblies to effect selective adjustment of the tension of the endless loop screen rotatably mounted on said drive shaft and driven shaft assemblies.

19. The solid waste handling system as claimed in claim 18, wherein said screen unit open frame assembly comprises a vertical frame member fixedly interposed between the upper and lower end housings of the drive shaft sprocket assembly and extending parallel to the drive shaft, wherein each of the upper and lower tensioners comprises threaded rods fixedly mounted, respectively to said upper and lower end housings of the drive shaft sprocket assembly and projecting at right angles to the drive shaft towards and being aligned with the upper and lower end housings of said driven shaft sprocket assembly, an internally threaded sleeve threadedly coupled to the end of each of said threaded rods remote from said drive shaft assembly end housings and movable axially towards and away from said drive shaft assembly upper and lower end housings, a locknut threadably mounted to each threaded rod for locking said sleeve at an axially adjusted position, and wherein each of the sleeves further comprises a connecting rod mounted coaxially to said sleeve for relative rotation thereto and operatively coupled at an end remote from the sleeve to the respective upper and lower end housings of said driven shaft assembly such that upon rotation of the sleeves of the upper and lower tensioners, the upper and lower end housings are moved and the lower end housings are moved towards and away from each other to effect tensioning of the screen carried by the screen unit drive shaft and driven shaft assemblies.

20. The solid waste handling system as claimed in claim 17, further comprising a plurality of vertically spaced support ways fixedly mounted between said drive shaft and said driven shaft on the downstream side of the upstream length of screen for supporting the front half of the endless loop screen during traverse across the influent stream.

21. A solid waste handling system for screening and grinding solids entrained in an influent liquid stream flowing within a flow confining chute, said chute having a bottom wall and laterally spaced vertical sidewalls defining a flow channel for said stream, said system comprising:

at least one rigid solids diverter horizontal rotating screen unit fixedly mounted within said chute and partially immersed in said influent liquid stream, said at least one rigid screen unit comprising an elongated open rigid frame assembly, an endless loop open screen mounted for rotation on said rigid frame assembly such that one upstream face of the screen moves horizontally across the stream, means for rotating said screen on said rigid frame to divert a portion of the stream flow in the direction of screen movement, to cause solids of the influent stream larger than a mesh size of the screen to impact upon said one upstream face and be moved horizontally in the direction of screen movement, and a solid waste grinder fixedly mounted within the flow stream and downstream of the endless loop screen, whereby solids entrained in the diverted portion of the influent stream are conveyed to an end of the screen proximate to said solid waste grinder, swept away from the screen by the diverted flow of influent passing over the end of the screen, and finely ground prior to discharge through an outlet port of said at least one solid waste grinder as waste effluent, wherein said open frame support assembly comprises a transverse metal frame extending laterally between opposed sidewalls of said chute, and a pair of oblique, parallel metal frame members extending obliquely to the direction of flow of the influent stream through the channel, having upstream ends fixedly mounted to said one sidewall and extending towards the other sidewall, the downstreammost one of said oblique frame members has an end intersecting said transverse frame member and fixedly mounted thereto, and wherein the length of the oblique frame members and the slot formed therebetween is in excess of the length of said screen unit, and wherein said screen unit is positioned between said oblique frame members with an upstream end in contact with said one sidewall and a downstream end spaced from said other sidewall of said chute so as to define, with said other sidewall said narrow portion of said channel, and wherein said grinder unit is fixedly mounted downstream of and offset from said transverse open frame member by said pair of short length open support frame angle bars with the inlet port thereof in the path of flow of the solids entrained within said diverted influent stream portion at the downstream end of the oblique screen unit.

* * * * *